US010460630B2

(12) United States Patent
Cao

(10) Patent No.: US 10,460,630 B2
(45) Date of Patent: Oct. 29, 2019

(54) BABY BOTTLE-ADAPTABLE REUSABLE LABEL

(71) Applicant: Kindest Company LLC, Ontario, CA (US)

(72) Inventor: Dinh Cao, Riverside, CA (US)

( * ) Notice: Subject to any disclaimer, the term of this patent is extended or adjusted under 35 U.S.C. 154(b) by 0 days.

(21) Appl. No.: 16/165,873

(22) Filed: Oct. 19, 2018

(65) Prior Publication Data

US 2019/0122586 A1 Apr. 25, 2019

Related U.S. Application Data

(60) Provisional application No. 62/575,146, filed on Oct. 20, 2017.

(51) Int. Cl.
*G09F 3/02* (2006.01)
*A61J 9/00* (2006.01)

(52) U.S. Cl.
CPC ..... *G09F 3/02* (2013.01); *A61J 9/00* (2013.01); *A61J 2205/30* (2013.01); *G09F 2003/0251* (2013.01); *G09F 2003/0273* (2013.01)

(58) Field of Classification Search
CPC ..... G09F 3/02; G09F 2003/0251; G09F 2003/0273; A61J 9/00; A61J 2205/30
See application file for complete search history.

(56) References Cited

U.S. PATENT DOCUMENTS 5,704,144 A * 1/1998 Groth ..... G09F 3/10 40/306
D802,376 S * 11/2017 Rivers ..... G09F 3/02 D7/624.2
2004/0205989 A1* 10/2004 Michaels ..... G09F 3/14 40/310
2005/0138854 A1* 6/2005 Simmons ..... G09F 3/14 40/665
2006/0207132 A1* 9/2006 Vaughan ..... G09F 3/14 40/310
2009/0015000 A1* 1/2009 Wolfe ..... B65D 23/14 283/74
2009/0145009 A1* 6/2009 Zinszer Desatoff ..... G09F 3/04 40/306
2009/0178313 A1* 7/2009 McManigal ..... G09F 3/00 40/310

(Continued)

*Primary Examiner* — Gary C Hoge
(74) *Attorney, Agent, or Firm* — Elizabeth Yang

(57) ABSTRACT

A baby bottle-adaptable reusable label provides a wide, resilient sleeve that snugly encapsulates a portion of a baby bottle to help identify the contents and provide information and instructions associated with the contents of the baby bottle. The sleeve has a length greater than the circumference. The sleeve is fabricated from a resilient fabric material that snugly encapsulates variously sized and dimensioned baby bottles. The sleeve includes an inner wall for engaging a bottle outer surface, an outer wall that is visible while affixed to the baby bottle. The outer wall is also configured to enable marking and erasing of a removable identifying indicia. This indicia is a characteristic relating to the contents of the baby bottle. The sleeve has a pair of peripheral edges running parallel and forming notches. The notch enables facilitated manipulation and gripping of the bottle during labeling and while a baby drinks from the bottle.

16 Claims, 5 Drawing Sheets

(56) References Cited

U.S. PATENT DOCUMENTS

| | | | | |
|---|---|---|---|---|
| 2009/0293328 | A1* | 12/2009 | Bull | G09F 3/005 40/310 |
| 2010/0236119 | A1* | 9/2010 | Pellei | G09F 3/14 40/638 |
| 2011/0173852 | A1* | 7/2011 | Rosen | B65D 23/14 40/310 |
| 2013/0019449 | A1* | 1/2013 | Didio | G09F 3/005 29/428 |
| 2013/0055607 | A1* | 3/2013 | Braun | G09F 3/00 40/633 |
| 2013/0152438 | A1* | 6/2013 | Morris | G09F 3/02 40/625 |
| 2015/0250683 | A1* | 9/2015 | Cross | A61J 9/06 206/459.1 |

* cited by examiner

BABY BOTTLE-ADAPTABLE REUSABLE LABEL

CROSS REFERENCE OF RELATED APPLICATIONS

This application claims the benefits of U.S. provisional application No. 62/575,146, filed Oct. 20, 2017 and entitled REUSABLE BABY BOTTLE LABELING SYSTEM, which provisional application is incorporated by reference herein in its entirety.

FIELD OF THE INVENTION

The present invention relates generally to a baby bottle-adaptable reusable label. More so, a reusable label adapted to be used with a baby bottle that provides a wide sleeve that snugly encapsulates a portion of the baby bottle to help identify the contents and provide information and instructions associated with the contents of the baby bottle; whereby the sleeve is fabricated from a resilient fabric material configured to snugly encapsulate variously sized and dimensioned baby bottles; whereby the sleeve includes an inner wall for engaging a bottle outer surface, an outer wall that is clearly visible while affixed to the baby bottle and markable, whereby the outer wall is configured to enable marking and erasing of a removable identifying indicia of at least one characteristic relating to the contents of the baby bottle; and the wide sleeve further defined by a peripheral edge running around the sleeve and forming at least one notch; whereby the notch enables facilitated manipulation and gripping of the bottle during labeling and while a baby drinks therefrom; and whereby the wide sleeve is portable in that it is made of fabric and other resilient materials so that it can be readily collapsed and carried in one's pocket.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Generally, the shape and dimension of a baby bottle is cylindrical and smooth. This configuration can make it difficult for a baby to grasp, especially when the bottle has fluid therein. The bottle must be held by a parent or otherwise obliquely supported with a towel or similar item. There are devices that allow a baby or the caregiver to grasp the baby bottle more easily during feeding.

Often, the parent depends on a third party to feed the baby. The parent must often provide specific instructions for the contents and recipient of the baby bottle. For example, the caregiver must know what time breast milk or formula was expressed or mixed, the name of the infant or child to whom the bottle belongs, at what time the infant or child is to be fed, and the expiration time of the milk. This is often resolved with peelable labels directly on the baby bottle.

Other proposals have involved baby bottle systems for labeling and gripping of baby bottles. The problem with these baby bottle systems is that they do not enable both labeling and efficient gripping of the bottle at the same time. Even though the above cited meet some of the needs of the market, a baby bottle-adaptable reusable label that is adapted to be used with a baby bottle to snugly encapsulate a portion of the baby bottle to help identify the contents and provide information and instructions associated with the contents of the baby bottle, and provide notches to help grip the bottle, is still desired.

SUMMARY

Illustrative embodiments of the disclosure are generally directed to a baby bottle-adaptable reusable label. The baby bottle-adaptable reusable label is adapted to be used with a baby bottle for multiple relabeling of indicia on the baby bottle. In some embodiments, the reusable label provides a wide sleeve that snugly encapsulates a portion of the baby bottle to help identify the contents and provide information and instructions associated with the contents of the baby bottle. The sleeve is fabricated from a resilient fabric material configured to snugly encapsulate variously sized and dimensioned baby bottles. The length of the sleeve is larger than the circumference of the sleeve.

In some embodiments, the sleeve may include an inner wall for engaging a bottle outer surface, and an outer wall that is clearly visible while affixed to the baby bottle. The outer wall is configured to enable marking and erasing of a removable identifying indicia of at least one characteristic relating to the contents of the baby bottle. The wide sleeve is further defined by a peripheral edge running around the sleeve and forming at least one notch. The notch enables facilitated manipulation and gripping of the bottle during labeling and while a baby drinks therefrom. Further, the wide sleeve is portable in that it is made of fabric and other resilient materials so that it can be readily collapsed and carried in a user's pocket.

One aspect of a bottle-adaptable reusable label, comprises:

- a resilient sleeve comprising a resilient fabric material, the sleeve being operable to enable snug encapsulation of a baby bottle,
- the sleeve being defined by an inner wall engaging an outer surface of the baby bottle,
- the sleeve further being defined by an outer wall oppositely disposed to the inner wall, the outer wall operable to enable marking and erasing of a removable identifying indicia, the removable identifying indicia defining at least one characteristic relating to a baby, or the contents of the baby bottle, or both,
- the outer wall comprising a pre-printed permanent identifying indicia,
- the sleeve further being defined by a pair of peripheral edges running around the walls, the peripheral edges forming at least one notch.

In another aspect, the sleeve has a generally cylindrical shape.

In another aspect, the outer wall of the sleeve is fabricated at least partially from silicon.

In another aspect, the at least one notch has a generally square shape.

One objective of the present invention is to provide a label that

Another objective is to provide a bottle-adaptable reusable label that allows for easy, repeated labeling directly on a baby bottle of at least one characteristic relating to a baby, or the contents of the baby bottle.

Another objective is to provide a reusable, washable surface for labeling a baby bottle.

Another objective is to avoid labeling a baby bottle with ink, stickers, labels, or tape leaves a gum-residue on the bottles.

Another objective is to keep track of how fresh the breast milk or formula is, labeling the container that contains the breast milk or formula.

Another objective is to keep track of multiple baby bottles pumped, thawed, or mixed on different days.

Another objective is to provide a resilient sleeve that fits around various sizes and dimensions of baby bottles.

Another objective is to enable the sleeve to be resilient so that it can be readily collapsed and carried in one's pocket.

Another objective is to provide an inexpensive to manufacture bottle-adaptable reusable label.

Some other advantages provided by the label are that it is reusable; washable; allows for marking a removable identifying indicia, even during condensation; contains information to ensure a caretaker can care for their infant or child according to the parent's instructions; and enables enhanced gripping of the baby bottle for removable identifying indicia and drinking therefrom.

Other labels, devices, methods, features, and advantages will be or become apparent to one with skill in the art upon examination of the following drawings and detailed description. It is intended that all such additional labels, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
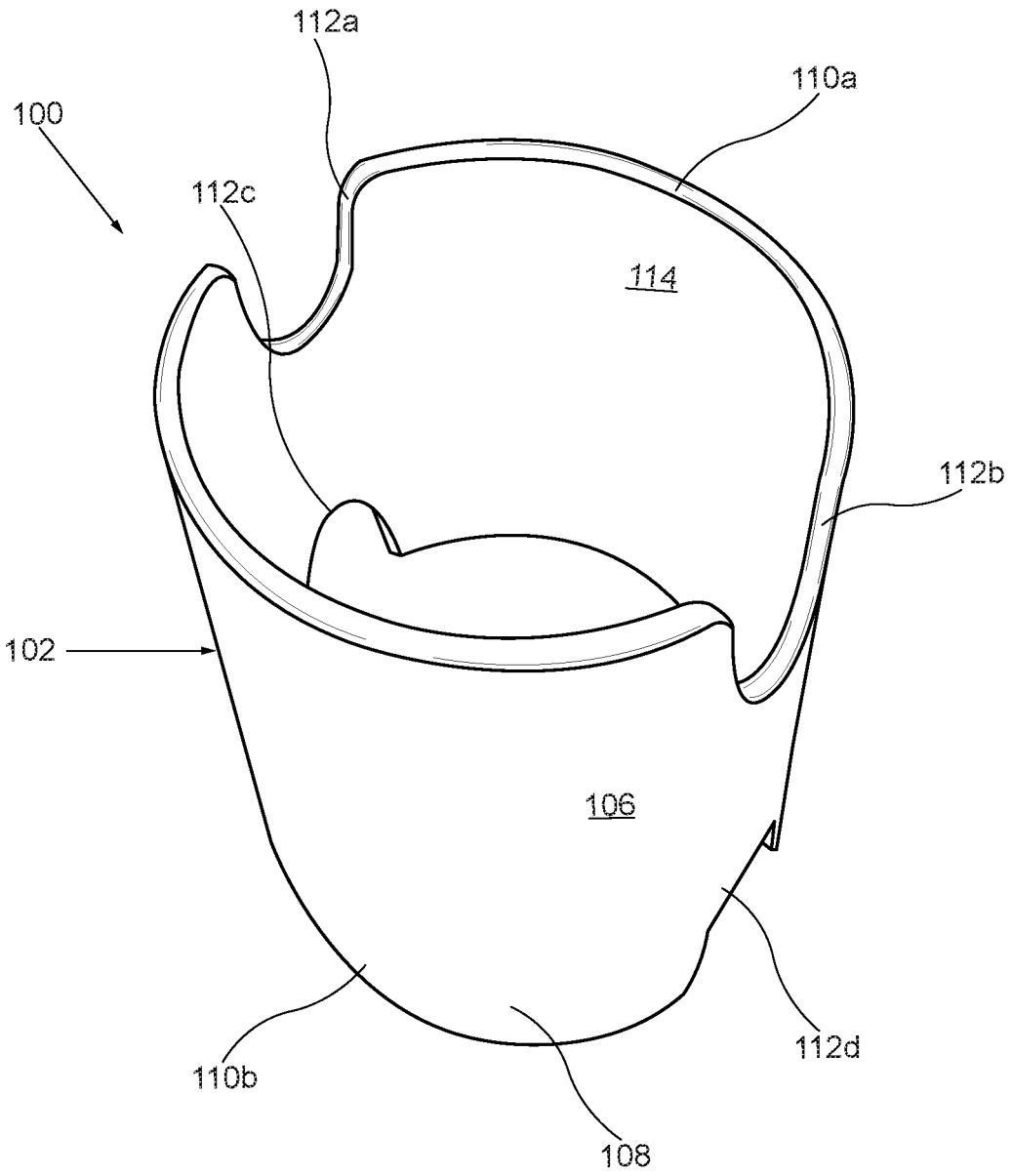
FIG. 1 illustrates a perspective view of an exemplary baby bottle-adaptable reusable label, showing a permanent indicia on the outer wall, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-5, a bottle-adaptable reusable label 100 provides a reusable, washable sleeve 102 that snugly encapsulates a portion of a baby bottle. The sleeve 102 enables multiple marking and erasing of a removable identifying indicia 104*a*, 104*b*, 104*c* in a visible space directly on the baby bottle. The removable identifying indicia 104*a-c* helps identify the contents and provide information and instructions associated with the contents of the baby bottle. The sleeve 102 is also configured with at least one notch 112*a*, 112*b* that enhances gripping of the baby bottle while marking and erasing the removable identifying indicia 104*a-c* therefrom, and while a baby grasps the baby bottle.

As referenced in FIG. 1, the bottle-adaptable reusable label 100, hereafter "label 100", comprises a wide sleeve 102 that detachably affixes to a baby bottle 200 to help identify the contents and instructions associated with the contents of the baby bottle 200. The sleeve 102 is fabricated from a resilient fabric material that is configured to snugly encapsulate variously sized and dimensioned baby bottles. In one embodiment, the sleeve 102 stretches to slidably receive the baby bottle 200, and thereby forming a visible label around the circumference of the baby bottle 200. Because of the resilient material, the wide sleeve 102 is portable in that it is made of fabric and other resilient materials so that it can be readily collapsed and carried in one's pocket.

In one non-limiting embodiment, the sleeve 102 is defined by an inner wall 114. The inner wall 114 engages a bottle outer surface 202. The sleeve 102 is further defined by an outer wall 106 opposite the inner wall 114. The outer wall 106 is clearly visible while the sleeve 102 encapsulates the baby bottle 200. The outer wall 106 is configured to enable marking and erasing of a removable identifying indicia 104*a*, 104*b*, 104*c* directly thereon. The removable identifying indicia 104*a-c* may include at least one characteristic relating to the baby, or the contents of the baby bottle, such as names, types of milk, dates, temperatures, and the like.

In other embodiments, the outer wall 106 has printed thereon, a pre-printed permanent identifying indicia 108, in addition to the removable identifying indicia 104*a-c*.

Examples of the pre-printed permanent identifying indicia 108 may include: "Baby Name"; "Milk Type"; "Date"; and "Parent Name". The user may mark erasable indicia 104*a-c* next to the pre-printed permanent identifying indicia 108 to further define the contents of the baby bottle. In one embodiment shown in FIG. 3, an indicia 104*a* is a name of a baby, an indicia 104*b* is a date for the content of the bottle, and an indicia 104*c* is a content of the baby bottle 200.

The wide sleeve 102 may further be defined by a pair of peripheral edges 110*a*, 110*b* running parallel around the inner and outer walls 114, 106. The peripheral edges 110*a*, 110*b* form at least one notch 112*a*, 112*b*, 112*c*, 112*d* that creates a gripping surface directly on the sleeve 102. In this manner, the notch 112*a-d* enables facilitated manipulation and gripping of the baby bottle during marking and erasing of the removable identifying indicia 104*a-c* on the outer wall 106, and also while a baby grasps the baby bottle 200 to drink therefrom.

Those skilled in the art will recognize that breast milk and formula have a limited shelf life; especially when fed to babies. The breast milk or formula may also require special instructions for feeding specific babies. Thus, to keep track of how fresh the breast milk or formula is, labeling the baby bottle that contains the breast milk or formula is helpful. Much like rotating produce or other perishable items in stores or restaurants, mothers, child-care providers and day-care centers use milk or formula from the earliest date first.

Thus, parents and caregivers often require a labeling solution that is reusable, washable, that withstands temperature changes and condensation, and that contains all the necessary information related to the contents of the baby bottle, so as to ensure that the contents of the bottle are dispensed to the baby according to instructions and the baby's needs.

Figure 2:
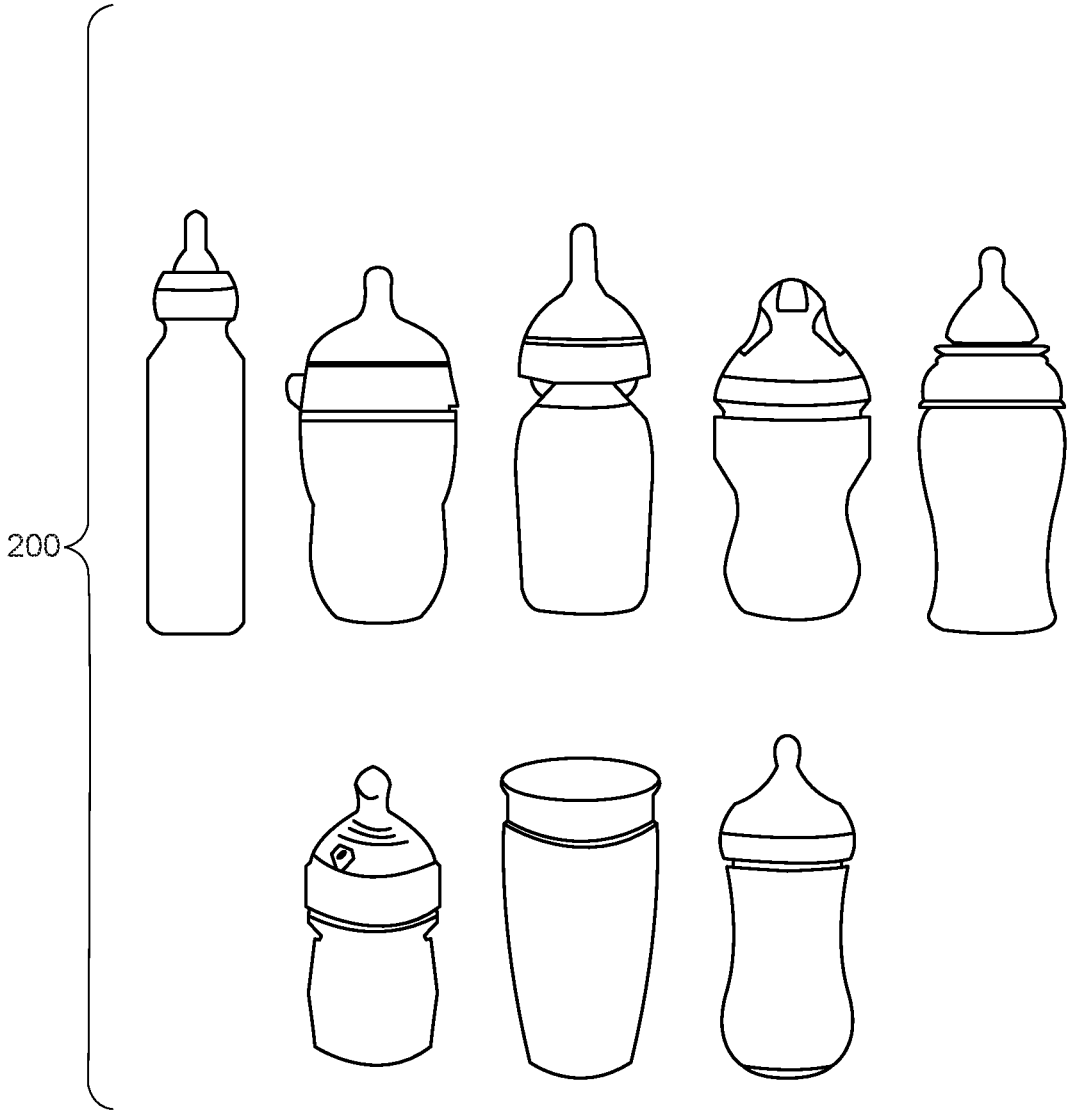
FIG. 2 illustrates a perspective view of a series of exemplary baby bottles that are operable with the reusable label, in accordance with an embodiment of the present invention.

It is also known that efforts to mark or label a baby bottle with ink, stickers, labels, or tape leaves a gum-residue on the bottles. Additionally, efforts to label a baby bottle with a permanent marker may not be a practical solution when applying multiple removable identifying indicia on the bottle over many days. Further, non-permanent markers have a tendency to rub off. It is also known that labels do not stick well, and markers do not write well on the baby bottles which are cold or have condensation on the outside. FIG. 2 illustrates the various types of baby bottles 200 that are known in the art for containing breast milk, or milk formula.

Thus, the present label 100 provides a resilient, wide sleeve 102 that snugly encapsulates the baby bottle 200; while also enabling marking and erasing of removable identifying indicia 104*a-c* from the sleeve 102, such that the removable identifying indicia 104*a*, 104*b*, 104*c* defines at least one characteristic relating to the contents of the baby bottle 200, or the baby. The label 100 further provides notches 112*a-d* that form along the peripheral edges 110*a-b* of the sleeve 102 to form an enhanced gripping surface for the baby bottle 200.

Figure 3:
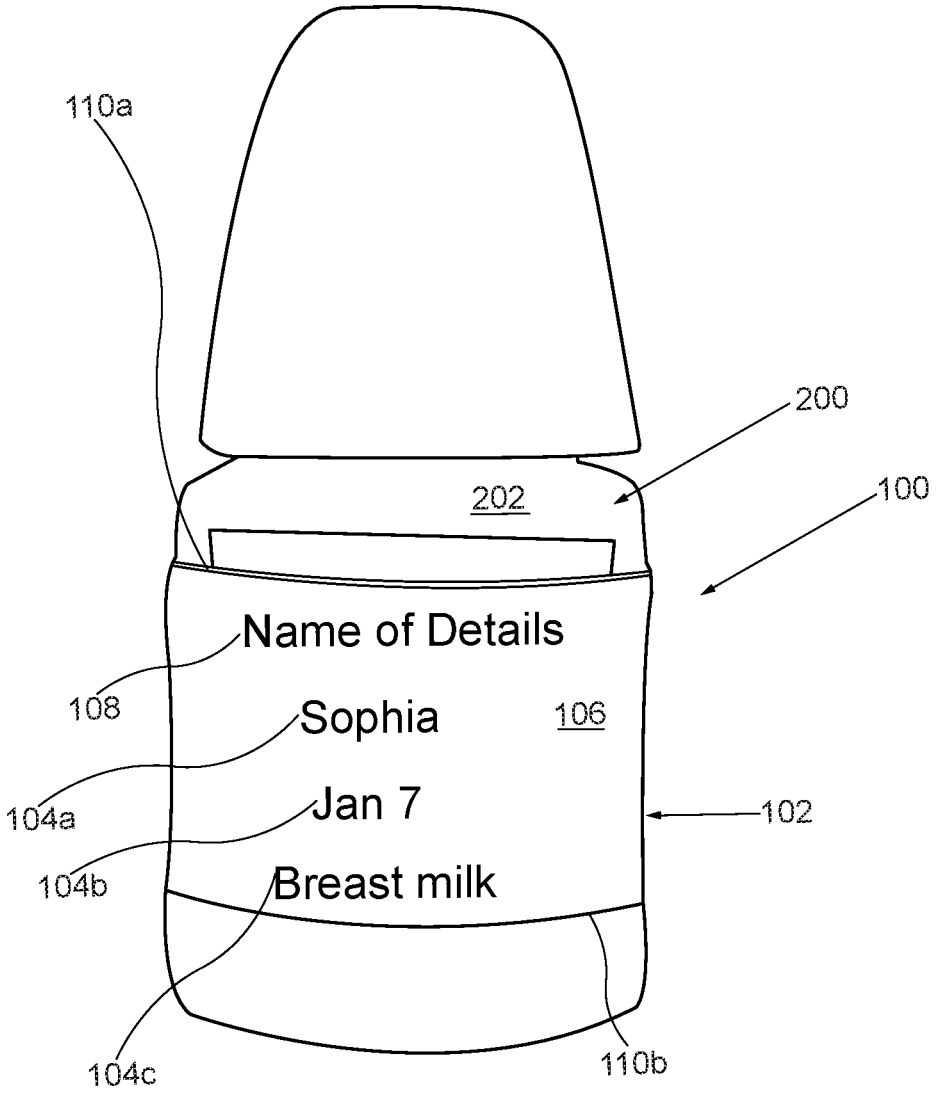
FIG. 3 illustrates a front perspective view of the baby bottle-adaptable reusable label attached to a baby bottle, showing a removable identifying indicia and a permanent indicia on the outer wall, in accordance with an embodiment of the present invention.

As referenced in FIG. 3, the label 100 comprises a generally wide sleeve 102. The sleeve 102 is sufficiently wide, so as to mark on, and clearly read the marked removable identifying indicia 104*a-c*. In one non-limiting embodiment, the sleeve 102 may have a length greater than a circumference. In other embodiments, the sleeve 102 is fabricated from a resilient fabric material that is configured to snugly encapsulate a baby bottle 200. For example, the sleeve 102 slidably receives the baby bottle 200, stopping at a midway point along the length of the baby bottle.

However in other embodiments, the sleeve 102 may roll out along the length of the baby bottle 200. In any case, the sleeve 102 encapsulates at least a portion of the baby bottle 200. It is significant to note that not only is a baby bottle 200 operable with the label 100, but any container used for storing milk, formula, and breast milk, and feeding a baby therefrom. For example, bottles, cups, and small food containers may also be labeled by the label 100.

One possible embodiment of the label 100 is operable with a baby bottle 200 that is defined by a bottle outer surface 202, a closed end, and an open end having a nipple. The baby bottle 200 is further sized and constructed to: allow a care giver to hold the infant and bottle in the same hand during the feeding process; enhance a caregiver's grasp of the bottle and comfort while gripping the bottle; increase control during the feeding process; and provide the maximum surface area on the outer surface 202 of the baby bottle 200 for the sleeve 102 to encapsulate.

Figure 4:
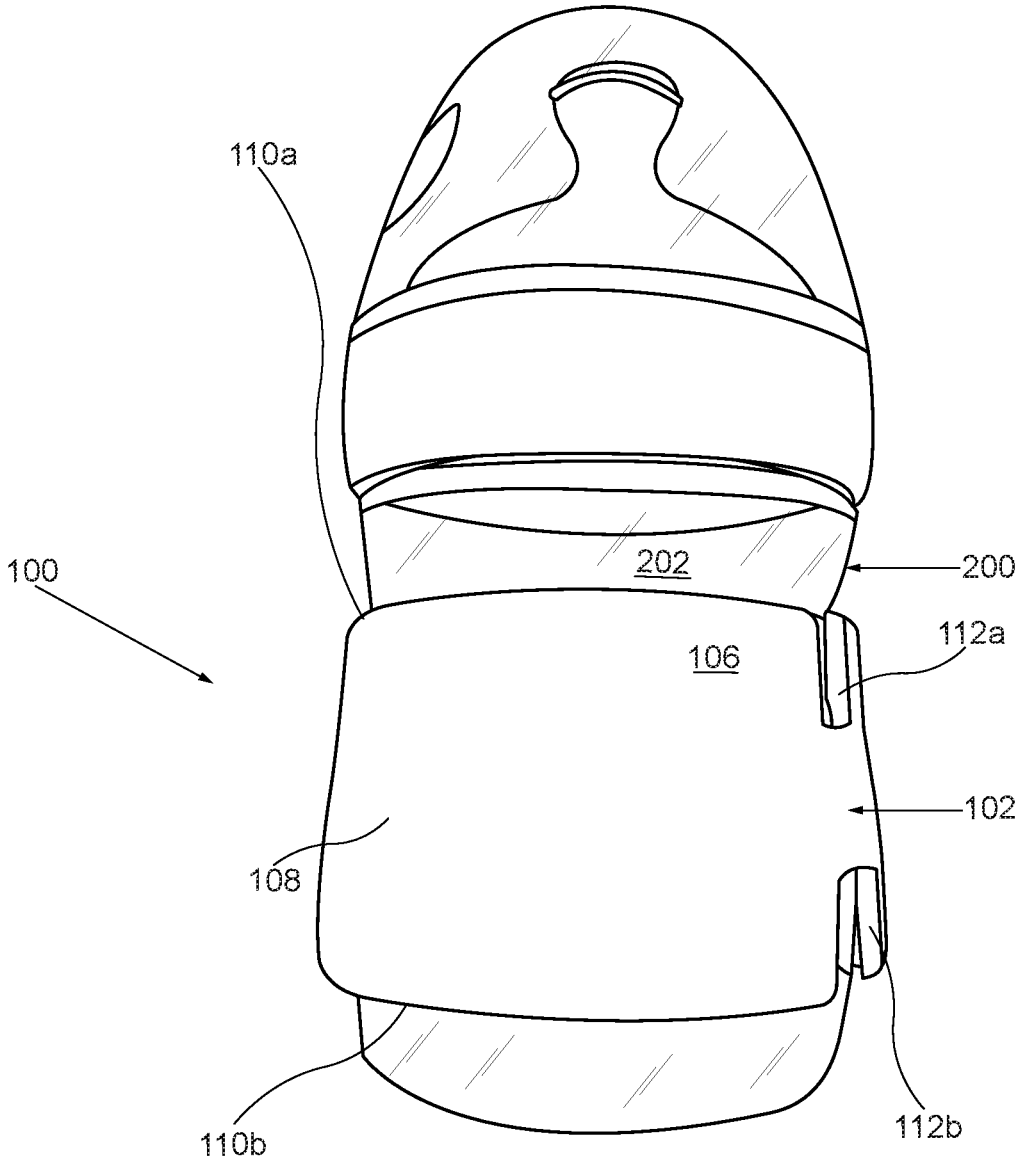
FIG. 4 illustrates a left side perspective view of the baby bottle-adaptable reusable label shown in FIG. 3, in accordance with an embodiment of the present invention.

Turning now to FIG. 4, the sleeve 102 is defined by an inner wall 114, an outer wall 106, and a peripheral edge 110*a-b*. The inner wall 114 is disposed to engage the bottle outer surface 202 of the baby bottle 200. In one embodiment, the inner wall 114 is sufficiently slick, so as to enable the bottle outer surface 202 to slide through. However, the inner wall 114 also has sufficient tact to snugly hold the sleeve 102 around the baby bottle 200.

Further, the sleeve 102 is defined by an outer wall 106 oppositely disposed of the inner wall. The outer wall 106 of the sleeve 102 is fabricated at least partially from silicon, which helps mark and erase the removable identifying indicia 104*a*, 104*b*, 104*c* applied by a marker. In this manner, the outer wall 106 is configured to enable fast, clean marking and erasing of the removable identifying indicia 104*a-c* therefrom. It is the at least partial silicon fabrication of the outer wall 106 that allows such facilitated markings to remain visible until wiped off.

In one possible embodiment, the flexible outer wall 106 is marked with dry-erase and wet-erase markers. Though any marking instrument known in the art of labeling may be used. The erasing of the removable identifying indicia 104*a-c* is generally accomplished with minimal wiping or washing efforts. In one embodiment, soap and water may be rubbed onto the removable identifying indicia 104*a-c*. This causes the removable identifying indicia 104*a-c* to substantially disappear from the outer wall 106. In this manner, the sleeve 102 can be repeatedly marked with new information after erasing old information.

Looking again at FIG. 3, the removable identifying indicia 104*a-c* on the outer wall 106 pertains to the content of the baby bottle, or the baby, or both. In some embodiments, the removable identifying indicia 104*a-c* may include, without limitation, the baby's name, if the contents are milk, the type of milk in the baby bottle, the times at which the milk should be consumed, a date, a temperature, an address, a caregiver's name. In alternative embodiments, the removable identifying indicia 104*a-c* may include a current history of immunizations, medications, and emergency telephone numbers, and a photograph of the baby.

In yet other embodiments, the outer wall 106 has printed thereon, a pre-printed permanent identifying indicia 108, in addition to the removable identifying indicia 104*a-c*. The pre-printed permanent identifying indicia 108 is not erasable from the outer wall 106. Examples of the pre-printed permanent identifying indicia 108 may include: "Baby Name"; "Milk Type"; "Date"; and "Parent Name".

In this manner, the removable identifying indicia 104*a-c* may be marked next to the pre-printed permanent identifying indicia 108 to further define the contents of the baby bottle 200. For example, as shown in FIG. 3, marking the name indicia 104*a* "Sophia" next to the pre-printed identifying indicia 108 of "Name of Details"; or marking the date indicia 104*b* of January 7 to identify an expiration date next to the pre-printed identifying indicia 108 of "Date". The contents of the baby bottle 200 may also be marked as "Breast Milk" indicia 104*c* to further provide feedback about the contents of the baby bottle 200.

Figure 5:
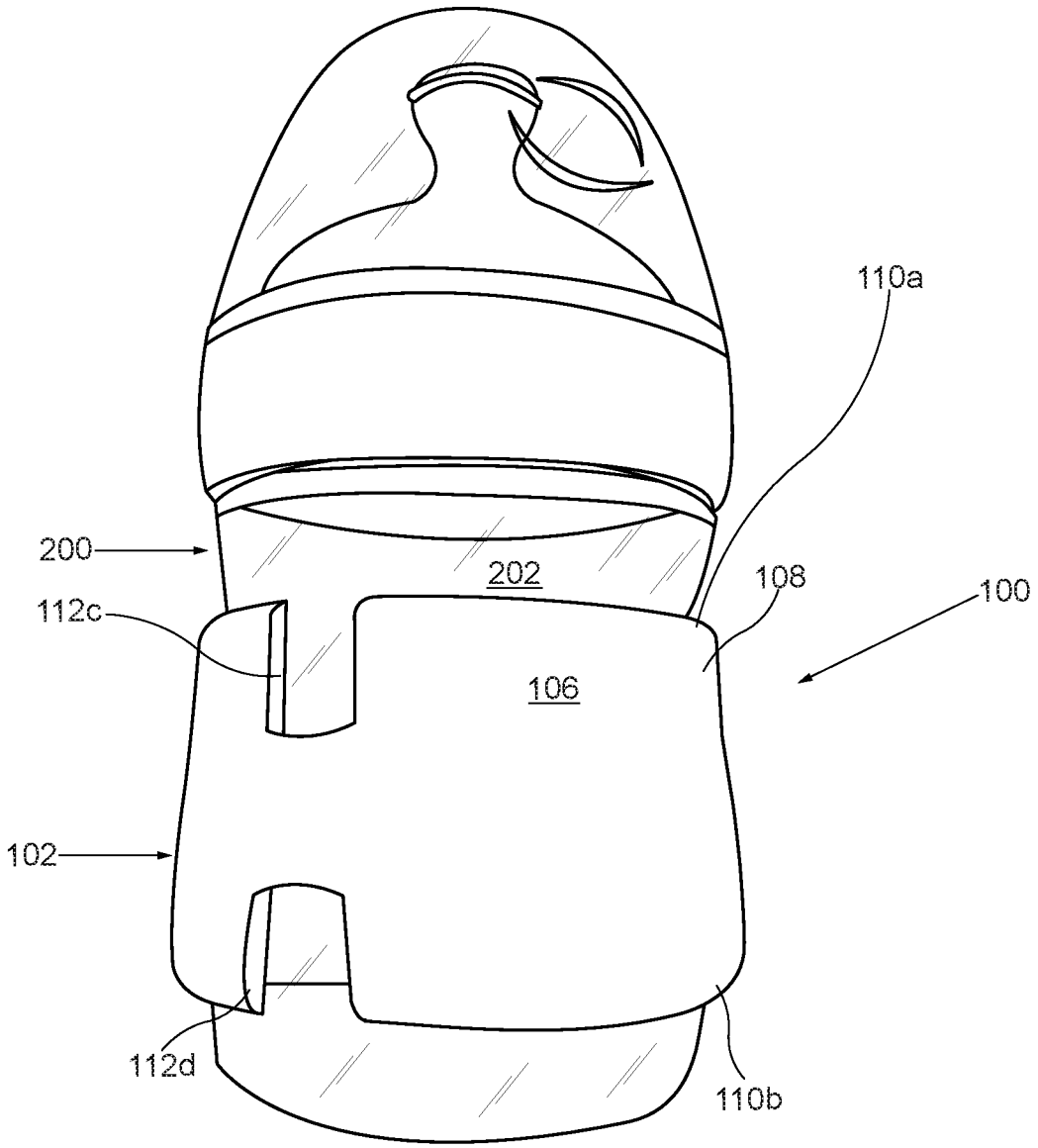
FIG. 5 illustrates a left side perspective view of the baby bottle-adaptable reusable label shown in FIG. 3, in accordance with an embodiment of the present invention.

As FIG. 5 shows, the sleeve 102 is further defined by a peripheral edge 110*a-b* running around the walls 106. The peripheral edge 110*a-b* may include an upper peripheral edge 110*a*, and a lower peripheral edge 110*b*. The peripheral edges 110*a-b* forms at least one notch 112*a-d*. In one embodiment, an upper notch 112*a* forms in the upper peripheral edge 110*a*; while a lower notch forms in the lower peripheral edge 110*b*. The notches 112*a*, 112*b* may have a block shape. Though in other embodiments, the notch 112*a-d* may have other shapes.

In some embodiments, the notches 112*a-d* form a gripping surface for enhanced manipulation of the sleeve 102 during removable identifying indicia thereon, and while the baby grasps the baby bottle during feeding. For example, the thumb rests in the notch 112*a* while tilting the bottle 200 back to drink. In one non-limiting embodiment, the sleeve 102 is 100% dishwasher and microwave safe. In yet another embodiment, the sleeve 102 is BPA free.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A baby bottle-adaptable reusable label, the label comprising:

a resilient sleeve comprising a resilient material, the sleeve being defined by an inner wall and an outer wall, the outer wall being oppositely disposed to the inner wall, the outer wall operable to enable marking and erasing of a removable identifying indicia, the outer wall comprising a pre-printed permanent identifying indicia, the sleeve further being defined by a pair of peripheral edges running around the walls, the peripheral edges forming four notches, wherein each of the peripheral edges has a thickness;

wherein each of the at least one notch has an inwardly-extended gripping surface for allowing the thumbs to rest thereon; and wherein each of the notches has a square shape, and each of the notches is arranged on an opposite side of the sleeve.

2. The label of claim 1, wherein the sleeve is operable to enable snug encapsulation of a baby bottle.

3. The label of claim 1, wherein the inner wall is operable to enable engagement of an outer surface of the baby bottle.

4. The label of claim 1, wherein the removable identifying indicia defines at least one of the following: the name of a baby, the contents of the baby bottle, or both.

5. The label of claim 1, wherein the sleeve has a cylindrical shape.

6. The label of claim 1, wherein the outer wall of the sleeve is fabricated at least partially from silicon.

7. The label of claim 1, wherein the removable identifying indicia includes at least one of the following: a name of a baby, the contents of the baby bottle, a time limit, a date, a temperature, an address, a name of a caregiver.

8. The label of claim 1, wherein the sleeve is 100% dishwasher and microwave safe.

9. A baby bottle-adaptable reusable label, the label comprising:

a resilient sleeve comprising a resilient fabric material, the sleeve being operable to enable snug encapsulation of a baby bottle;

the sleeve being defined by an inner wall engaging an outer surface of the baby bottle;

the sleeve further being defined by an outer wall oppositely disposed to the inner wall, the outer wall operable to enable marking and erasing of a removable identifying indicia, the removable identifying indicia defining at least one characteristic;

the outer wall comprising a pre-printed permanent identifying indicia;

the sleeve further being defined by a pair of peripheral edges running around the walls; the peripheral edges forming four notches wherein each of the peripheral edges has a thickness;

wherein each of the at least one notch has an inwardly-extended gripping surface for allowing the thumbs to rest thereon; and wherein each of the notches has a square shape, and each of the notches is arranged on an opposite side of the sleeve.

10. The label of claim 9, wherein the sleeve has a cylindrical shape.

11. The label of claim 9, wherein the outer wall of the sleeve is fabricated at least partially from silicon.

12. The system of claim 9, wherein the removable identifying indicia includes at least one of the following: a name of a baby, the contents of the baby bottle, a time limit, a date, a temperature, an address, and a name of a caregiver.

13. The label of claim 9, wherein the sleeve is 100% dishwasher and microwave safe.

14. A baby bottle-adaptable reusable label, the label consisting of:

a resilient sleeve comprising a resilient material, the resilient material comprising at least partially silicone, the sleeve being operable to enable snug encapsulation of a baby bottle, the sleeve having a cylindrical shape;

the sleeve being defined by an inner wall engaging an outer surface of the baby bottle;

the sleeve further being defined by an outer wall oppositely disposed to the inner wall, the outer wall operable to enable marking and erasing of a removable identifying indicia, the removable identifying indicia defining at least one characteristic;

the outer wall comprising a pre-printed permanent identifying indicia;

the sleeve further being defined by a pair of peripheral edges running around the walls, the peripheral edges forming four notches; and wherein each of the at least one notch has an inwardly-extended gripping surface for allowing the thumbs to rest thereon; and wherein each of the notches has a square shape, and each of the notches can be arranged on an opposite side of the sleeve.

15. The system of claim 14, wherein the removable identifying indicia includes at least one of the following: a name of a baby, the contents of the baby bottle, a time limit, a date, a temperature, an address, and a name of a caregiver.

16. The label of claim 14, wherein the sleeve is 100% dishwasher and microwave safe.

* * * * *